United States Patent [19]

Chun et al.

[11] Patent Number: 4,929,276

[45] Date of Patent: May 29, 1990

[54] MULTITOOL PUNCH HOLDER

[75] Inventors: Victor L. Chun, Holland; James R. Hunter, Chadds Ford; George Jaworski, Bala Cynwyd, all of Pa.

[73] Assignee: Murata Wiedemann, Inc., King of Prussia, Pa.

[21] Appl. No.: 355,237

[22] Filed: May 22, 1989

[51] Int. Cl.[5] ..... B26F 1/08

[52] U.S. Cl. ..... 83/552; 83/139; 83/146; 83/563; 83/618

[58] Field of Search ..... 83/552, 549, 556, 559, 83/563, 618, 146, 139

[56] References Cited

U.S. PATENT DOCUMENTS

| | | | |
|---|---|---|---|
| 3,049,038 | 11/1958 | Friedland | 83/552 |
| 3,160,046 | 8/1962 | Bredow | 83/552 X |
| 3,527,130 | 9/1970 | Knehans | 83/552 X |
| 3,765,285 | 10/1973 | Achler et al. | 83/552 X |

*Primary Examiner*—Douglas D. Watts
*Assistant Examiner*—Kenneth E. Peterson
*Attorney, Agent, or Firm*—John R. Benefiel; Raymond J. Eifler

[57] ABSTRACT

A multitool punch holder (12) having a head member (26) coupled to a punch press ram (16) as the press upper turret plate (22) rotates to bring the punch holder (12) into alignment with the ram (16). The punch holder (12) includes a rotary tool carrier (56) carrying a series of punches (80), each able to be selectively rotated into alignment beneath a striker rod (100) slidably mounted in a non rotating body member (30). Stroking of the ram (16) causes an engagement feature (108) to engage the striker rod (100) when the head member (26) telescopes into the body member (30) after axial movement of the holder (12) is arrested by contact with the workpiece (120). The striker rod (100) is then driven to force the coupled individual punch (80) into the workpiece (120). The striker rod (100) is urged to a raised position by an encircling stripper spring (110). A separation spring (42) urges the ram (16) and body member (30) to retracted position with the striker rod (100) out of engagement with the ram engagement feature (108). A detachable striker plate (88) of urethane provides non-marring contact with the workpiece (120).

12 Claims, 3 Drawing Sheets

MULTITOOL PUNCH HOLDER

SUMMARY OF THE INVENTION

The present invention comprises a multitool punch holder comprised of a rotary tool carrier having a circumferential array of bores each adapted to receive a punch tool, a rotary gear drive enabling indexing of the carrier by rotation about its axis.

A non-rotatable punch holder body member is coupled to the press ram, and carries a punch striker rod at one angular location, biased upwardly by a single powerful stripping spring. The rotatable punch carrier is mounted beneath the punch holder for rotation about an axis aligned with the press ram, the carrier circumferential array of bores each receiving a respective punch. The punch striker rod is aligned and coupled to each punch successively as the carrier is rotated. As the ram is stroked downwardly, the punch holder and carrier descend together until the lower face of the carrier encounters the workpiece, at which point further downward movement of the assembly ceases.

The ram thereafter continues its descent by telescoping into the body member, and engages the protruding upper end of the punch striker rod, which is then advanced to force the single punch indexed beneath the striker rod through the workpiece.

This arrangement has the advantage of being simple and compact, and enables the use of a single powerful stripping spring acting on the striker rod to generate very adequate stripping forces.

DETAILED DESCRIPTION

Figure 1:
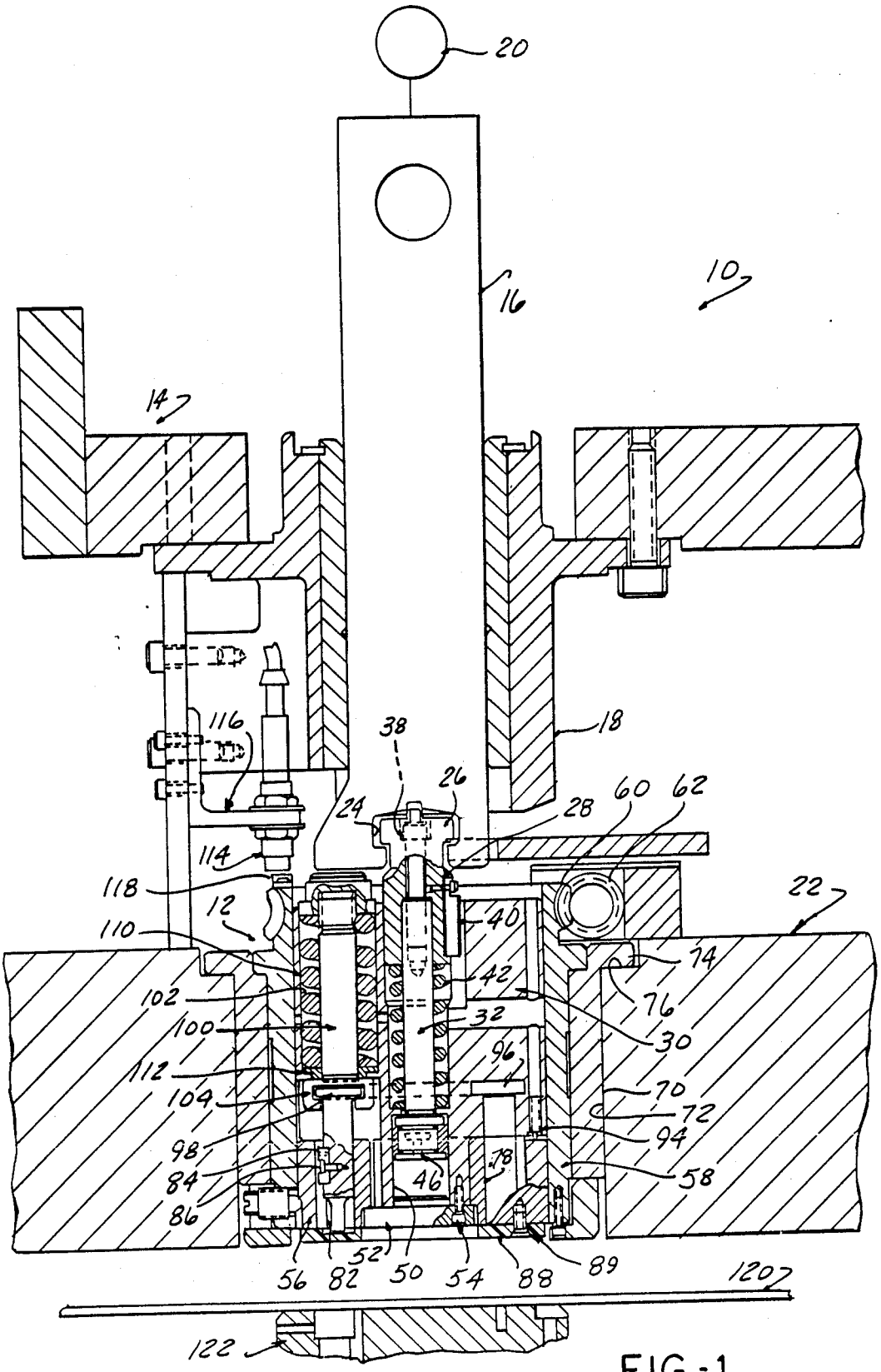
FIG. 1 is a sectional view of a multitool punch holder according to the present invention together with fragmentary portions of a punch press into which the holder is installed.
Figure 1A:
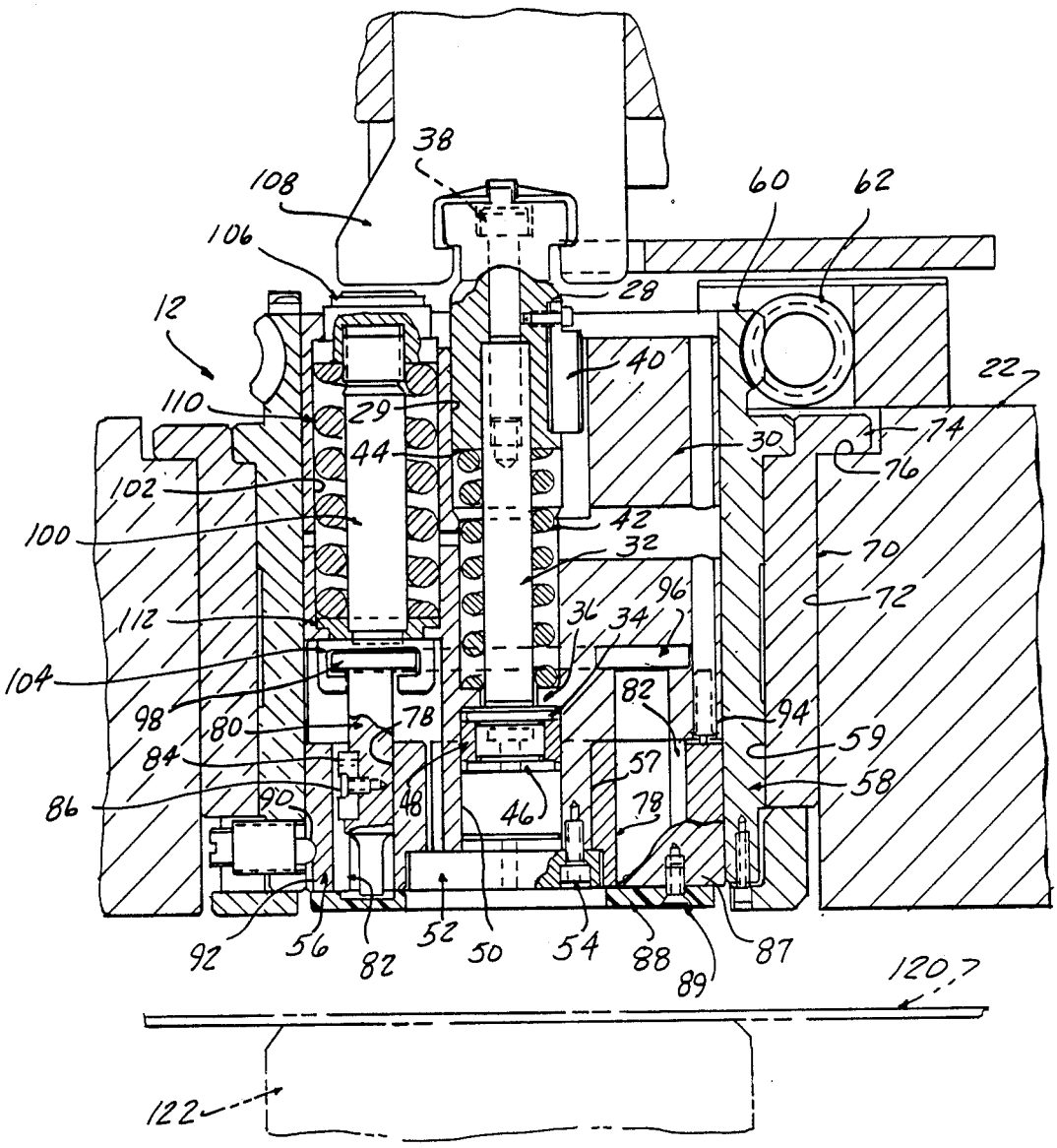
FIG. 1A is an enlarged fragmentary portion of the view of FIG. 1.

FIG. 1 illustrates portions of a punch press 10 into which is installed a multitool punch holder 12 according to the present invention. These punch press portions include a machine frame 14 supporting a punch ram 16 in a ram housing assembly 18. The ram 16 is adapted to be reciprocated by a ram drive mechanism 20 in conventional fashion.

The punch press 10 also includes an upper rotary turret plate 22, in which is installed the punch holder assembly 12. The rotary turret plate 22 also typically will carry other punch holders, either of a conventional single punch type or of the multitool type according to the present invention, with rotation of the turret plate 22 bringing a selected holder into mating engagement with the ram 16.

For this purpose, the ram 16 is formed with a transverse tee slot 24 which is adapted to receive the complementarily shaped head portion 26 of a punch holder head member 28 included in the punch holder assembly 12.

The head member 28 is received within a bore 29 formed in a cylindrical punch holder body member 30, and over one end of a mounting rod 32. The mounting rod includes a flange 34 abutting a shoulder 36 formed along bore 29 in the punch holder body member 30.

A cap screw 38 is threadably engaged in the upper end of the mounting rod 32 and secures the head member 28 to the mounting rod 32. The head member 28 is keyed at 40 to the punch holder body member 30 to prevent relative rotation. When the head portion 26 is seated in the slot 24, this prevents rotation of the head member 28 and thus the punch holder body member 30 is also fixed against rotation.

A compression spring 42 is interposed between the shoulder 36 and the lower end 44 of head member 28, which allows the head member and mounting rod 32 to telescope into the bore 29 in the punch holder body member 30 as the ram 16 descends when the upward acting force of the compression spring 42 is overcome.

A second flange 46 holds a guiding split bushing 48 controlling axial movement in the bore 50 at the lower end of the punch holder body member 30. A plug 52 is secured with a cap screw 54 to retain a rotatable punch carrier 56 on a boss extension 57 of the punch holder body member 30.

The cylindrical punch carrier 56 and the punch holder body member 30 are received within a gear sleeve 58 integral with a worm gear 60 driven by a worm 62 to index the sleeve 58.

Figure 2:
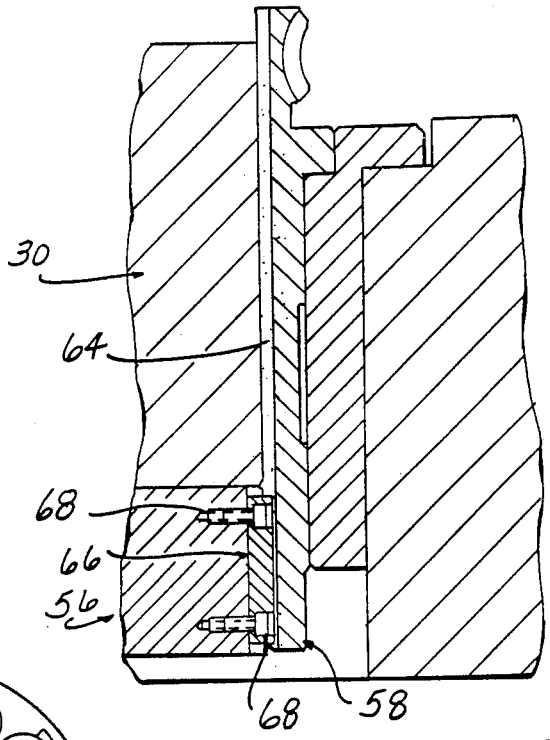
FIG. 2 is a fragmentary sectional view of a portion of the punch holder assembly shown in FIGS. 1 and 1A.

FIG. 2 shows that the gear sleeve 58 is formed with a keyway 64 which receives a key 66 attached to the punch carrier 56 by capscrews 68. The sleeve 58 thus may rotationally drive the punch carrier 56 while relative axial movement therebetween is accommodated.

The gear sleeve 58 is rotationally mounted within a bushing 70 mounted within a bore 72 in the upper turret plate 22, with a flange 74 seating on counterbore 76 to axially locate the bushing 70 therein.

Figure 3:
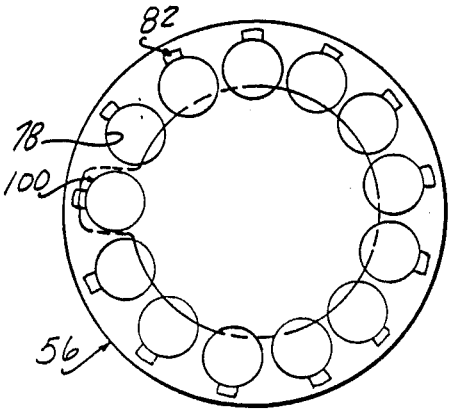
FIG. 3 is an upper end view of the multitool punch holder shown in FIG. 1.

FIG. 3 shows that the punch carrier 56 is formed with a circumferentially spaced array of twelve axially extending bores 78, each adapted to receive a respective punching tool 80. A keyway 82 is formed along each bore 78 to accommodate a key 84 attached to the punching tool 80 in the bore 78 during stroking, as necessary for nonround punches.

Referring again to FIG. 1, an annular urethane stripper plate 88 is attached to the lower end face 87 of the punch carrier 56 with screws 89 so as to close off the bores 78. The punches 80 will each penetrate the stripper plate 82 during the initial punching operation to obviate the need for separately forming openings therein. The softness of the urethane stripper plate 88 prevents marring of the workpiece surface, but for increased wear, a preformed steel stripper plate can be employed where the marring is not a problem.

The punch holder body member 30 and punch carrier 56 are normally retained in the axial direction within the gear sleeve 58 by a series of detent spring urged plungers 90 included and biased into engagement with a groove 92 formed into the outside of the punch carrier 56.

A second spring plunger assembly 94 acts between the punch holder body member 30 and punch carrier 56 to angularly locate the same in a "home" or initially assembled relative angular position. This retains the components in this position against any tendency to drift as a result of vibrations, etc.

The punch holder body member 30 is formed with a circumferential tee shaped slot 96 which accommodates the tee heads 98 of each punch tool 80 to allow the punches 80 to be rotated with the punch carrier 56 while the body member 30 remains stationary.

A striker rod 100 is mounted in a bore 102 in the punch holder body member 30 axially offset from the axis of rotation of the carrier 56 to able to be successively aligned with each of the bores 78 and punches 80 in the punch carrier 56. The striker rod 100 includes a slotted lower end piece 104 adapted to receive each punch tool 80 as it is rotated beneath the bore 102. An upper hardened cap 106 is threaded onto the strike rod 100 and adapted to withstand the pressure of a ram foot portion 108 aligned with the striker rod 100.

A heavy compression spring force stripper spring 110 encircles the striker rod 100, is seated against a bushing 112 and acts beneath the cap 106 to resist downward axial movement of the striker rod 100 when engaged by the ram foot portion 108.

A proximity switch 114 is mounted on a bracket 116 over a holding piece 118 attached to the end of the gear sleeve 58 to enable reference of the position of the assemblage with respect to home position.

Figure 4:
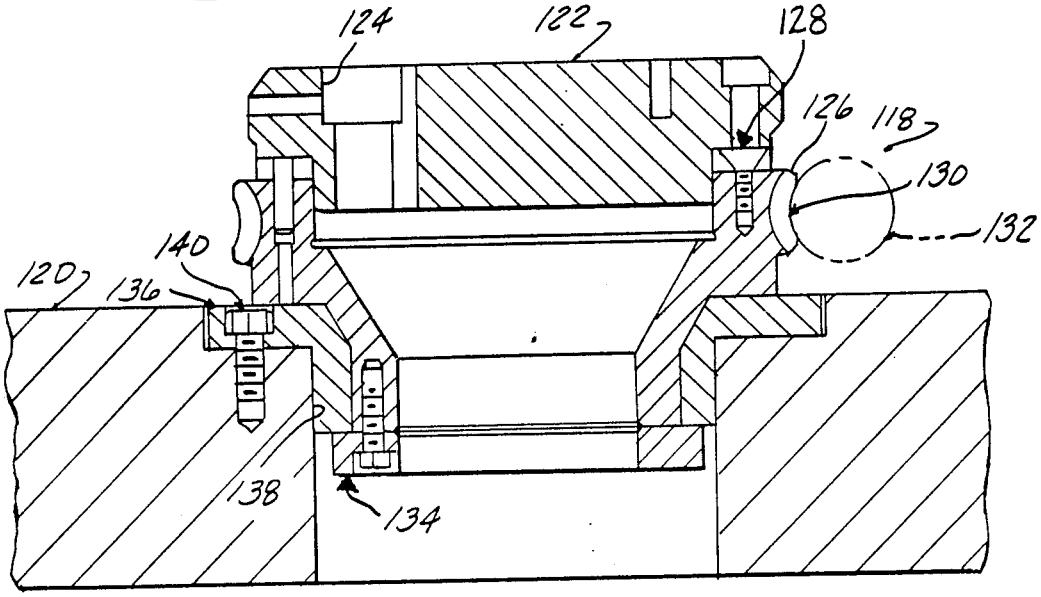
FIG. 4 is a sectional view of a die holder assembly adapted to be used with the punch holder according to the present invention, together with adjacent portions of the punch press in which the punch and die holders are installed.

FIG. 4 illustrates a rotary die holder 118 mounted in a lower turret 120 included in the punch press 10. This includes a die holder member 122 having a series of upwardly facing bores or pockets 124 each adapted to receive a die to mate with a given punch 80. The bores 124 are radially outwardly spaced identically to the location of the punches 80 so as to be in alignment therewith beneath the striker rod 100. An indexing gear 126 is secured to the die holder with screws 128, and is formed with a worm gear 130 in mesh with a worm 132 to be driven thereby.

A clamping ring 134 is secured to a bushing 136 to retain the same on the gear 126. The bushing 136 is fixed in a bore 138 formed in the lower turret 20 by capscrews 140. Thus, the die holder 122 may be indexed correspondingly to the carrier 56 to match the proper die and punch.

In operation, the worm 62 is driven to bring a selected punch tool 80 beneath the striker rod 100 with the corresponding die 124 indexed to bring the mating die the same position. The ram 16 is activated and the entire assembly moves downwardly until the stripper plate 88 contacts the upper surface of a workpiece 120 positioned atop a die assembly 122, arresting further axial movement of the holder (12).

The head member 28 then commences to telescope into the body member 30, allowing the ram foot to approach and contact the cap 106 of the striker rod 100. The striker rod 100 then advances to drive the punch tool 80 located beneath the striker rod down to penetrate the workpiece 120, while compressing the stripper spring 110 and stripper plate 88.

The ram 16 thereafter is elevated to release the striker rod 100, and the compressed stripper spring 110 acts to raise the striker rod 100 and thereby withdraw the punch tool 80 from the workpiece. Since a very powerful spring can be employed, i.e., 700 pounds (nominal) spring force, stripping is very reliable. The closely fit hole in the stripper plate 88 resulting from its method of formation of the same by punching prevents cratering of the workpiece as the punch is withdrawn.

We claim:

1. In combination with a multitool punch holder (12) for engagement with a reciprocating ram (16) of a punch press apparatus (10), said multitool punch holder (12) including a rotary tool carrier (56) holding a circumferential array of punches (80) and enabling selective ram driving of any one of said plurality of punches (80) by rotation of said tool carrier (56) about an axis by an indexing drive therefor, characterized by a body member (30) interposed between said tool carrier (56) and said ram (16); a coupling means (26) connecting said ram (16) to said body member (30) to prevent rotation but allow relative axial movement therebetween; a striker rod (100) extending parallel to said punches (80) and slidably mounted in said body member at a location offset from the axis of rotation of said carrier so as to be aligned with each punch (80) successively as said tool carrier (56) is rotated; a stripper spring (110) urging said striker rod (100) to an elevated position in said body member (30) above said punches (80); said striker rod (100) having an upper end extending above said body member (30) and a lower end adapted to engage a punch; an engagement feature (108) on said ram (16) located to engage said striker rod (100) upper end after a predetermined relative axial movement between said ram (16) and said body member (30) from a separated position; separator spring means (42) urging said ram (16) and said body member (30) apart to said separated position; whereby upon continued downward movement of said ram (16), driving engagement of said body member (30) with a workpiece (120) arrests further downward movement of said body member (30), said separator spring means (42) thereafter overcome to cause said ram engagement feature (108) to engage and advance said striker rod (100), by continued downward movement of said ram (16) against the resistance of said stripper spring (110) enabling said striker rod (100) to contact and drive a punch (80) disposed beneath said striker rod (100) to cause punching of said workpiece (W) by said punch (80).

2. The multitool punch holder according to claim 1 wherein said tool carrier (56) comprises a cylindrical member having an array of axially extending parallel bores (78) arranged about said axis of rotation thereof, each of said parallel bores (78) adapted to received a punch (80).

3. The multitool punch holder according to claim 2 wherein said body member (30) comprises a cylindrical member aligned above said tool carrier (56), said body member (30) and tool carrier (56) secured together so as to enable said rotation of said tool carrier (56) while said body member (30) remains rotationally fixed.

4. The multitool punch holder according to claim 3 wherein said body member (30) is formed with an axial bore (102) offset from said axis of rotation of said tool carrier (56), said bore slidably receiving said striker rod (100), said stripper spring (110) acting to bias said striker rod (100) to a position with the lower end thereof above said punches (80) in said tool carrier (56).

5. The multitool punch holder according to claim 4 wherein said coupling means includes a head member (28) having a portion (26) adapted to be non rotationally coupled with said ram (16), said head member (28) telescopically received in said body member (30) but rotationally fixed relative thereto.

6. The multitool punch holder according to claim 3 wherein said body member (30) is formed with a circumferential slot (96) extending axially into an end face abuting said tool carrier, said slot (96) receiving said punches (80) and accommodating rotation of said tool carrier (56) relative said body member (30).

7. The multitool punch holder according to claim 6 wherein said punches each are formed with a tee head (98) at the upper end thereof; said striker rod (100) carries a tee slotted end piece (104) adapted to receive each punch tee head (98) as said tool carrier (56) is rotated to carry each punch (80) into alignment with said striker rod (100), and said circumferential slot (96) is also tee shaped to accommodate said punches (80).

8. The multitool punch holder according to claim 3 wherein said engagement feature (108) comprises a protuberance (108) formed on said ram (16) extending radially outward to be located above said striker rod (100).

9. The multitool punch holder according to claim 1 further including a sleeve (58) rotationally mounted in said punch press (10) and having a bore (59) receiving said body member (30) and tool carrier (56) in axial alignment with each other, said sleeve (58) attached to said tool carrier (56).

10. The multitool punch holder according to claim 9 further including drive gear means (60, 62) adapted to rotate said sleeve (58).

11. The multitool punch holder (12) according to claim 1 further including a striker plate (88) and means (89) detachably attaching said striker plate (88) to the lower face (87) of said carrier (56) to engage said workpiece (120) during punching.

12. The multitool punch holder (12) according to claim 11 wherein said striker plate (88) is constructed of urethane plastic.

* * * * *